United States Patent [19]

Cotton

[11] 4,051,966

[45] Oct. 4, 1977

[54] TIRE MANIPULATING APPARATUS

[75] Inventor: Larry G. Cotton, Clear Lake, Iowa

[73] Assignee: Iowa Mold Tooling Co., Inc., Garner, Iowa

[21] Appl. No.: 625,114

[22] Filed: Oct. 23, 1975

[51] Int. Cl.[2] ..... B66C 3/16

[52] U.S. Cl. ..... 214/332; 214/333; 214/652; 294/88; 294/DIG. 2

[58] Field of Search ..... 214/652, 653, 332–333, 214/701 R; 294/86 R, 67 BB, 88, DIG. 2, 81 R, 67 R

[56] References Cited

U.S. PATENT DOCUMENTS

| | | | |
|---|---|---|---|
| 2,746,630 | 5/1956 | Sinclair | 214/653 |
| 3,076,673 | 2/1963 | Kaplan et al. | 294/86 R |
| 3,511,263 | 5/1970 | Emke | 214/653 |
| 3,655,232 | 4/1972 | Martelee | 294/67 BB |
| 3,927,778 | 12/1975 | Zrostlik | 214/332 |

*Primary Examiner*—Albert J. Makay
*Assistant Examiner*—George F. Abraham
*Attorney, Agent, or Firm*—Wegner, Stellman, McCord, Wiles & Wood

[57] ABSTRACT

A tire manipulating apparatus has a rotatable head and means for raising and lowering the head. Tire gripping means consists of a pair of spaced, parallel tubular housings which are secured to the head in a common plane, and two L-shaped members, each of which has a first arm telescoped in a housing and a second arm, said second arms being inclined with respect to the first arms so that their free ends are coaxial. Linear motors extend and retract the L-shaped members to grip a tire. Opposed tire gripping elements on the free ends of the arms are rotatable about a common axis by coordinately operable power units to turn a tire gripped by the elements.

7 Claims, 6 Drawing Figures

TIRE MANIPULATING APPARATUS

BACKGROUND OF THE INVENTION

Allowed United States patent application of Francis L. Zrostlik, Ser. No. 351,776, filed Apr. 16, 1973, issued on Dec. 23, 1975 as U.S. Pat. No. 3,927,778 for "Tire Changing Apparatus" owned by applicant's assignee, discloses a simple and rugged tire gripping mechanism for a tire manipulating and tire changing apparatus. The tire gripping arms there disclosed are spaced apart and parallel, so that the tire gripping elements at the free ends of the arms are not aligned. The very large tires which such apparatus is designed to handle are difficult to manipulate at best; and it has been found that the lack of alignment between the tire gripping members increases the difficulty of handling a large tire properly.

The problem is particularly acute when a tire is to be picked up which is lying flat on a supporting surface. To do so, the tire gripping elements of the apparatus must both be in the same horizontal plane; and to get them in the same horizontal plane requires that the head on which the tire gripping mechanism is mounted be axially rotated, putting the parallel housings of the mechanism at an angle to the horizontal. It is difficult for an operator to judge the angle properly so that he knows when the tire gripping elements are in the same horizontal plane.

SUMMARY OF THE INVENTION

The principal object of the present invention is to provide tire gripping mechanism for a tire manipulating apparatus which constitutes an improvement upon the tire gripping mechanism of U.S. patent application Ser. No. 351,776. (U.S. Pat. No. 3,927,778) This is accomplished by axially aligning the tire gripping elements so that they are in the same horizontal plane when the parallel housings of the tire gripping mechanism are horizontal. Thus, when the parallel housings are horizontal the tire gripping elements may grippingly engage diametrically opposite areas of the tread surface of a tire which is lying flat upon a horizontal surface.

Another object of the invention is to provide tire gripping mechanism which simplifies axial rotation of the tire and also simplifies alignment of a tire with a vehicle wheel upon which it is to be mounted.

Yet another object of the invention is to provide fully power operated tire manipulating apparatus which may be mounted upon a truck crane as disclosed in patent application Ser. No. 351,776, (U.S. Pat. No. 3,927,778) or which may be mounted upon a fork lift truck in place of the forks, or which may be mounted upon the arms of a front end loader in place of the scraper.

THE DRAWINGS

DETAILED DESCRIPTION OF THE INVENTION

First Embodiment

Figure 1:
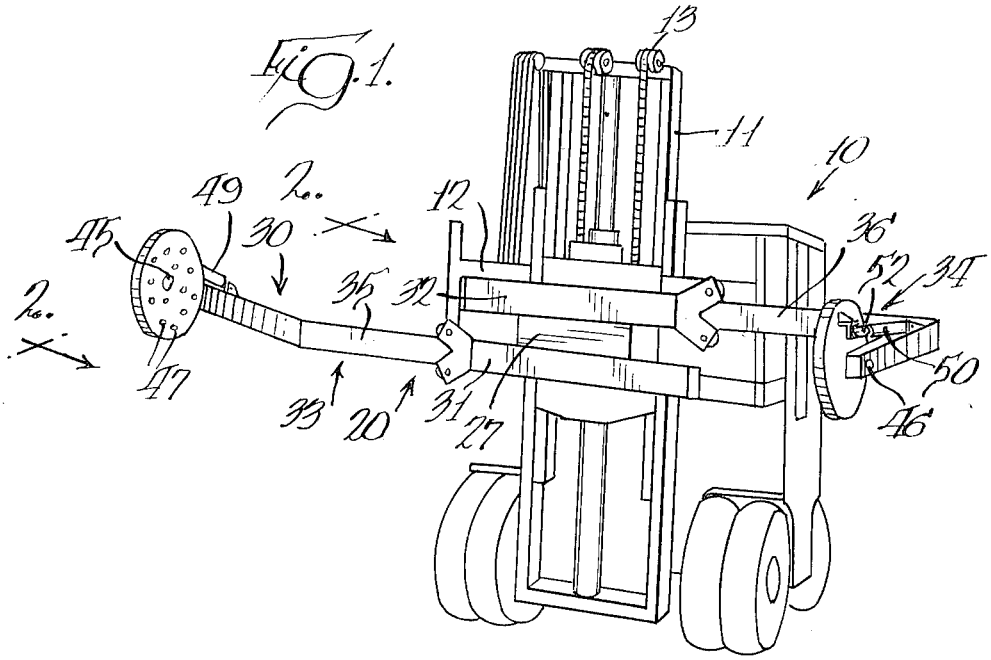
FIG. 1 is a perspective view of a first embodiment of the apparatus of the present invention which is mounted upon a fork lift truck.

Referring to FIG. 1, the apparatus of the invention is illustrated as mounted upon a commercially available fork lift truck, indicated generally at 10, which includes the usual upright guide means 11 in which a carriage 12 is supported for vertical reciprocation by means of a chain drive 13. The lift forks are removed from the carriage 12 so that the present tire manipulating apparatus, indicated generally at 20, may be mounted on the carriage.

Figure 3:
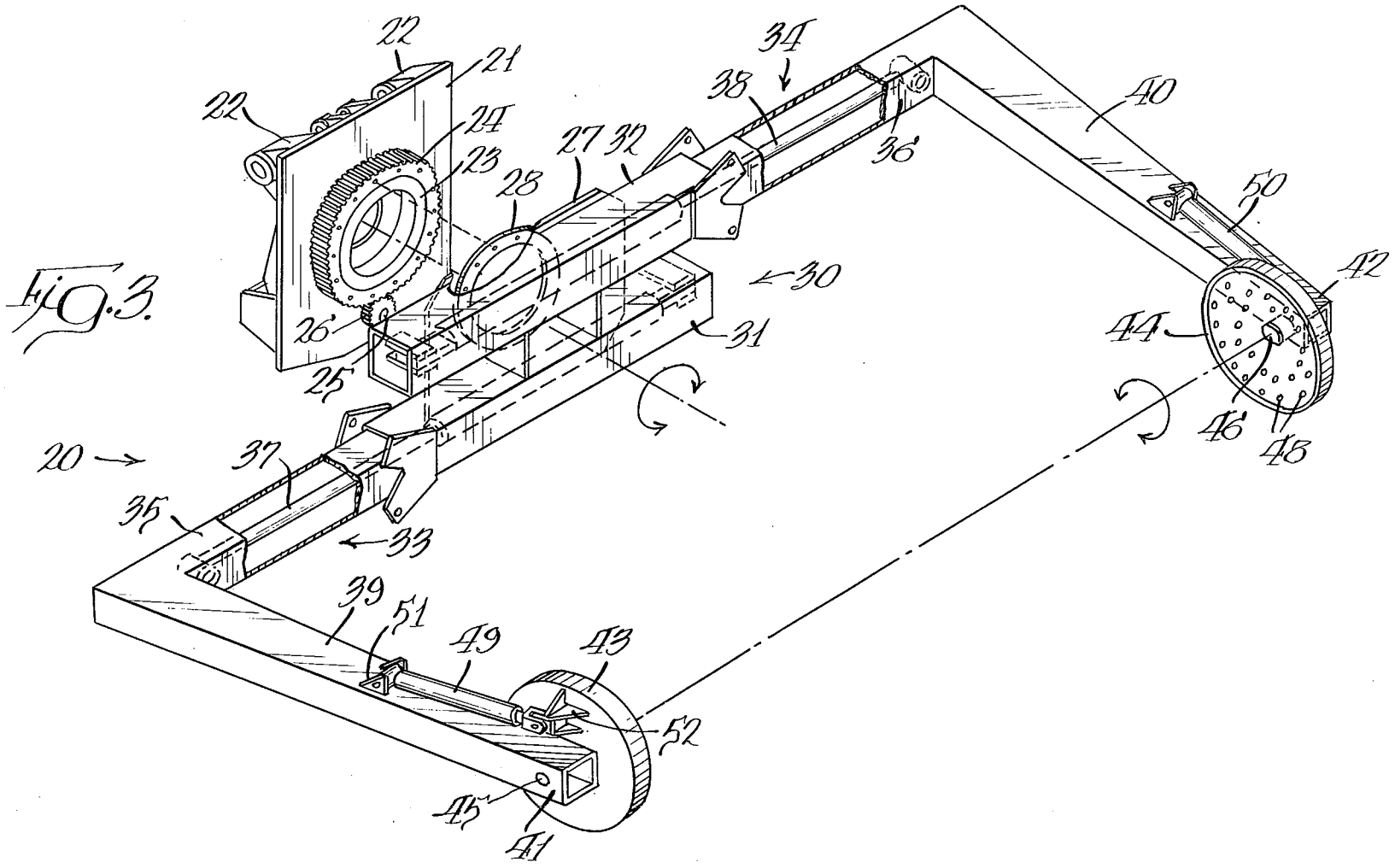
FIG. 3 is an exploded perspective view of the tire manipulating apparatus of the invention.

Referring now to FIG. 3, the apparatus 20 includes a mounting plate 21 at the upper rear of which are aligned bosses 22 to receive pin means (not shown) which support the mounting plate 21 upon the carriage 12. Fixedly secured to the front of the plate 21 is an annular bearing assembly 23, and journalled upon the bearing assembly is a ring gear 24. A hydraulic motor (not shown) is mounted upon the rear of the plate 21 and has a forwardly projecting shaft 25 that carries a pinion 26 which is engaged with the ring gear 24 to rotate the latter about the bearing assembly 23. A head 27 is provided with a mounting ring 28 which is bolted to the ring gear 24 so that rotation of the ring gear rotates the head 27.

Tire gripping means, indicated generally at 30, is mounted upon the rotatable head 27. It consists of a pair of spaced, parallel, tubular housings 31 and 32 which are fixedly secured to the front of the rotatable head 27 so that they lie in a common plane which, when the apparatus is mounted upon a fork lift carriage, is vertical. However, it is apparent that if the structure were carried upon a truck crane this plane would shift with changes in orientation of the crane boom. As shown in the second embodiment, when the structure is mounted upon the arms of a front end loader the head is maintained in an upright position as the loader arms are moved.

L-shaped members, indicated generally at 33 and 34, are operatively associated, respectively, with the tubular housings 31 and 32. The L-shaped members have first arms 35 and 36 which are respectively telescoped in the housings 31 and 32; and linear motors in the form of hydraulic cylinders and pistons 37 and 38 are mounted, respectively, in the housings 31 and 32 and operatively connected to the L-shaped members 33 and 34 to extend and retract the latter for the purpose of gripping or releasing a tire.

Figure 2:
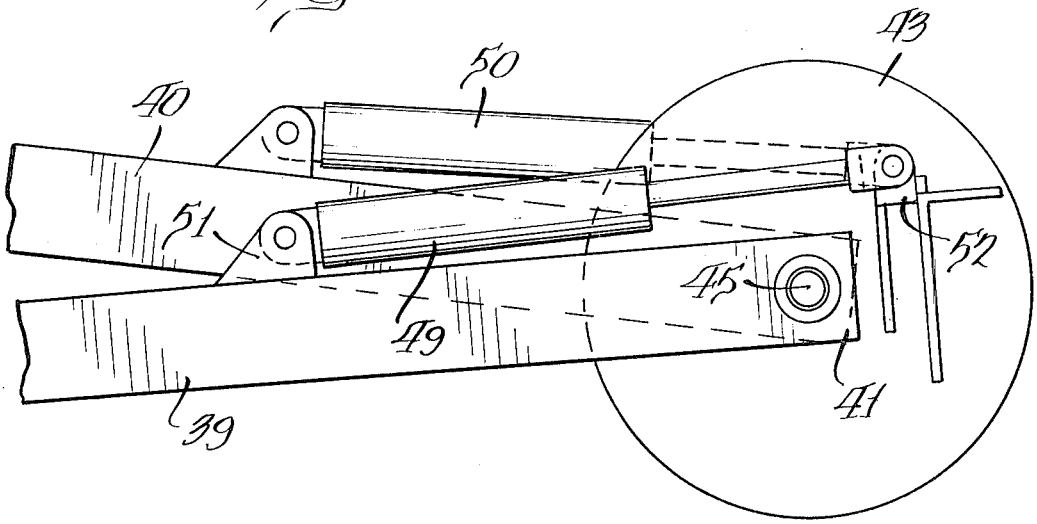
FIG. 2 is a fragmentary side elevational view on an enlarged scale taken substantially as indicated along the line 2—2 of FIG. 1.

The L-shaped members 33 and 34 also include second arms 39 and 40, respectively, which are respectively integral with the first arms 35 and 36. As best seen in FIG. 2, the arm 39 is inclined upwardly toward its outer end 41, while the arm 40 is inclined downwardly toward its outer end 42, so that said outer ends are coaxial and in a median plane between and parallel to the housings 31 and 32.

Opposed tire gripping elements 43 and 44 are rotatably mounted, respectively, on coaxial stub shafts 45 and 46; and the tire gripping elements 43 and 44 are provided with tire engaging studs 47 and 48, respectively.

Concurrent rotary motion of the tire gripping elements 43 and 44 is provided by a pair of hydraulic cylinder and piston units 49 and 50; each of which has one end pivotally mounted upon a bracket 51 on the arm 39 or 40, as the case may be, and the other end of which is pivotally connected to a bracket 52 on the associated tire gripping element 43 or 44. The location of the brackets 51 and 52, and the extension of which the units 49 and 50 are capable, permits the tire gripping elements 43 and 44 to rotate a full 90° in order that a tire lying flat upon a supported surface may be picked up by the tire gripping means 30 and manipulated into a vertical position by rotation of the gripping elements 43 and 44.

SECOND EMBODIMENT

Figure 4:
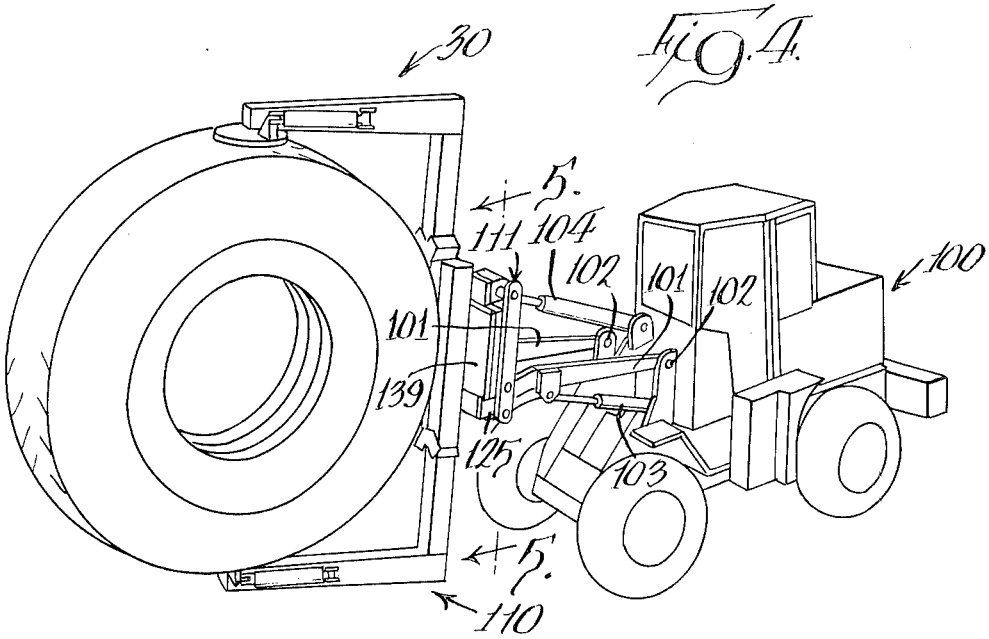
FIG. 4 is a perspective view of a second embodiment of the apparatus of the invention which is mounted upon the arms of a front end loader, with a large off-the-road vehicle tire held in a vertical position in the tire gripping means.
Figure 5:
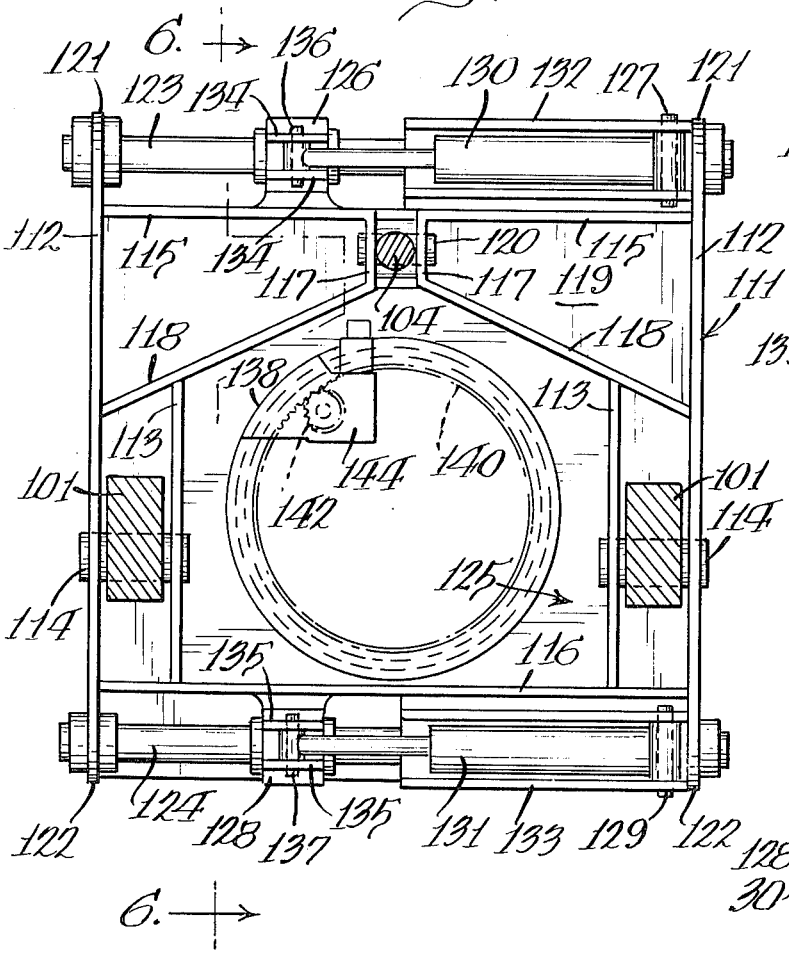
FIG. 5 is a transverse sectional view on an enlarged scale, taken substantially as indicated along the line 5—5 of FIG. 4.
Figure 6:
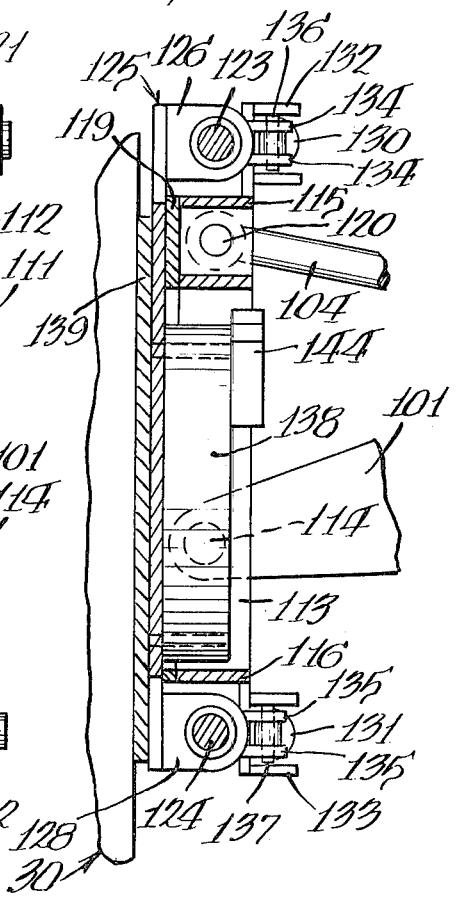
FIG. 6 is a longitudinal sectional view taken substantially as indicated along the line 6—6 of FIG. 5.

Referring now to FIGS. 4, 5 and 6, the second embodiment of the invention is seen as mounted upon a front end loader, indicated generally at 100, which has the usual pair of lift arms 101 which are mounted upon aligned transverse pivots 102 for swinging movement in a vertical plane by a pair of hydraulic cylinder units such as the unit 103. When the front end loader 100 is to be used as a tire handling apparatus, the usual scraper or bucket is detached from the arms 101 and a tire manipulating apparatus, indicated generally at 110, is mounted on the arms in place of the scraper or bucket. The apparatus 110 has a tire gripping means, indicated generally at 30, which is identical with that of the first embodiment; so it is not described again.

A support means for the tire gripping means 30 includes a support structure, indicated generally at 111, which has external side plates 112 and interior side plates 113 which receive mounting pins 114 by means of which the structure 111 is supported upon the lift arms 101. The structure 111 also includes aligned upper cross members 115, a bottom cross member 116, spaced central webs 117 which connect to diagonal webs 118, and a front plate 119 which surrounds a central opening defined by the members 113, 116 and 118. The upright central webs 117 are provided with aligned holes to receive a pin 120 by means of which the upper end of the structure 111 is pivotally connected to the piston rod of an attitude control cylinder and piston unit 104 which is a part of the front end loader structure that is conventionally connected to the upper margin of the scraper or bucket to control the attitude of the scraper on the arms 101.

The side plates 112 of the mounting structure 111 are extended above and below the top and bottom plates 115 and 116 to provide upper ears 121 and lower ears 122 which respectively receive an upper transverse rod 123 and a lower transverse rod 124 which act as supports for a mounting plate, indicated generally at 125. The mounting plate 125 is positioned forwardly of the front plate 119 of the structure 111 and has rearwardly extending upper hollow bosses 126 and 127 which slidingly embrace the upper rod 123, and lower rearwardly extending hollow bosses 128 and 129 which slidingly embrace the lower rod 124. Thus, the mounting plate 125 is transversely movable on the support structure 111, and transverse movement of the mounting plate 125 is provided by upper and lower hydraulic cylinder and piston units numbered, respectively, 130 and 131, which are respectively mounted in brackets 132 and 133 which are carried upon the upper transverse members 115 and the lower transverse member 116, respectively. The upper and lower hollow bosses 126 and 128 are provided, respectively, with rearwardly extending vertically spaced flanges 134 and 135 which support upright pins 136 and 137, respectively, to which the piston rods of the hydraulic units 130 and 131 are respectively connected.

Extending rearwardly from the mounting plate 125 into the opening defined by the members 113, 116 and 118 is an annular flange 138 which carries a ball bearing assembly; and a head 139 upon which the tire gripping means 30 is carried has a rearwardly extending, internally toothed ring gear 140 which is rotatably mounted in said bearing assembly. A hydraulic motor 141 which is supported upon the annular flange 138 has a driven pinion 142 which is in driving engagement with the internally toothed ring gear 140 so that the head 139 may be rotated upon the mounting plate 125.

The rotatable mounting of the head 139 permits the tire gripping means 30 to be rotated between the position of FIG. 4 in which a tire is vertically oriented and a position in which the tire is horizontally oriented. The capability for orienting the tire in the position of FIG. 4 is of great assistance in transporting huge tires of off the road vehicles, the largest of which are in excess of 11 feet in diameter and weight 3 ½ tons.

In addition, the lateral adjustment of the head 139 which is afforded by the transverse movement of the mounting plate 125 is extremely helpful in mounting a tire upon a vehicle. The tire may be brought to a transverse orientation with respect to the front end loader 100 and may then be rotated to a vertical position by rotation of the tire gripping elements 43 and 44. The lift arms 101 are lowered until the tire is nearly on the ground, with the aspect control cylinder 104 maintaining the support structure 111 in a vertical plane, and the tire may be precisely aligned with a vehicle wheel upon which it is to be mounted by lateral adjustment of the mounting plate 125 through the use of the hydraulic units 130 and 131.

As a result, a relatively inexpensive tire manipulating means mounted upon a front end loader can provide substantially all of the freedom of manipulation of a tire that has formerly been available only by the use of a truck mounted crane with a tire handling apparatus having three pivot axes, as taught in Zrostlik U.S. Pat. No. 3,858,735.

The foregoing detailed description is given for clearness of understanding only and no unnecessary limitations should be understood therefrom, as modifications will be obvious to those skilled in the art.

I claim:

1. In a tire manipulating apparatus which includes a mounting member, means supporting said mounting member on a vehicle mounted structure for raising and lowering the mounting member, an axially rotatable head on the mounting member, and means for rotating said head, the improvement comprising, in combination:

means for moving the mounting member laterally on the vehicle mounted structure;

a pair of spaced, parallel, tubular housings on the rotatable head, said housings being in a common plane;

an L-shaped member operatively associated with each of said housings, each of said members having a first arm telescoped in one of the housings, and a second arm, at least one of said second arms being inclined with respect to said first arms so that the free ends of the second arms are coaxial;

opposed tire gripping elements at the free ends of the L-shaped members;

and power operated means for coordinately extending and retracting said L-shaped members so that the tire gripping elements may grippingly engage diametrically opposite areas of the tread surface of a tire the diameter of which is in a plane parallel to said tubular housings and normal to said common plane.

2. The combination of claim 1 in which both of the second arms are inclined so that the free ends of said arms are in a median plane between and parallel to the housings.

3. The combination of claim 1 in which the tire gripping elements are rotatable about the common axis, and coordinately operable power units are operatively connected to the second arms and to said tire gripping elements to rotate the latter for turning a tire gripped by said elements.

4. The combination of claim 3 in which the power units are hydraulic cylinders and pistons.

5. The combination of claim 1 in which the vehicle mounted structure is a vertically reciprocable, power operated carriage, and the mounting member is secured to said carriage in a fixed, upright plane.

6. A tire manipulating apparatus which is mounted upon a wheeled vehicle that has a front end and a rear end, said apparatus comprising, in combination:

a pair of parallel arms pivoted on a first transverse horizontal axis on the front end of the wheeled vehicle;

powered means for swinging said parallel arms about said first horizontal axis;

a mounting member;

means supporting said mounting member on the free ends of said arms for pivotal movement about a second transverse horizontal axis, said means supporting the mounting member including a support structure pivoted on said second transverse horizontal axis, and power operated means for moving the mounting member laterally on said support structure;

means connected to the parallel arms and to the mounting member and acting coordinately with the powered means to maintain said mounting member effectively in an upright position as said parallel arms are swung about said first transverse horizontal axis;

a head supported on the mounting member for rotation about a longitudinal horizontal axis;

a pair of spaced, parallel, tubular housings on the front of said head, said housings being in a common plane;

an L-shaped member operatively associated with each of said housings, each of said members having a first arm telescoped in one of the housings, and a second arm, at least one of said second arms being inclined with respect to said first arms so that the free ends of the second arms are coaxial;

and power operated means for coordinately extending and retracting said L-shaped members so that the tire gripping elements may grippingly engage diametrically opposite areas of the tread surface of a tire the diameter of which is in a plane parallel to said tubular housings and normal to said common plane.

7. The combination of claim 6 in which the support structure includes a pair of parallel, laterally extending rods, the mounting member has hollow bosses slidably mounted on said rods, and the power operated means moves said mounting member on said rods.

* * * * *